US008714856B2

(12) United States Patent
Ishii

(10) Patent No.: US 8,714,856 B2
(45) Date of Patent: May 6, 2014

(54) BALLPOINT PEN TIP, BALLPOINT PEN REFILL, BALLPOINT PEN, AND METHOD OF MANUFACTURING BALLPOINT PEN TIP

(75) Inventor: Yoshihide Ishii, Yokohama (JP)

(73) Assignee: Mitsubishi Pencil Company, Limited, Tokyo (JP)

( * ) Notice: Subject to any disclaimer, the term of this patent is extended or adjusted under 35 U.S.C. 154(b) by 0 days.

(21) Appl. No.: 13/254,052

(22) PCT Filed: Mar. 10, 2010

(86) PCT No.: PCT/JP2010/053952
§ 371 (c)(1),
(2), (4) Date: Oct. 26, 2011

(87) PCT Pub. No.: WO2010/104101
PCT Pub. Date: Sep. 16, 2010

(65) Prior Publication Data

US 2012/0039663 A1 Feb. 16, 2012

(30) Foreign Application Priority Data

Mar. 10, 2009 (JP) ..... 2009-056468

(51) Int. Cl.
*B43K 7/10* (2006.01)

(52) U.S. Cl.
USPC ..... 401/216; 401/209

(58) Field of Classification Search
USPC ..... 401/216, 208, 209
See application file for complete search history.

(56) References Cited

U.S. PATENT DOCUMENTS

| | | | | |
|---|---|---|---|---|
| 2,891,511 | A * | 6/1959 | Fehling | 401/216 |
| 3,708,234 | A * | 1/1973 | Fukuda | 401/216 |
| 4,384,800 | A | 5/1983 | Dyama | |
| 7,914,222 | B2 * | 3/2011 | Inoue et al. | 401/216 |

FOREIGN PATENT DOCUMENTS

| | | | |
|---|---|---|---|
| JP | 52-70617 | A | 6/1977 |
| JP | 56-14082 | U | 7/1979 |
| JP | 56-14083 | U | 7/1979 |
| JP | 10-193863 | A | 7/1998 |
| JP | 2002-321485 | A | 11/2002 |
| JP | 2006-289807 | A | 10/2006 |
| JP | 2009-006636 | A | 1/2009 |
| JP | 2009-006637 | A | 1/2009 |

OTHER PUBLICATIONS

International Search Report of PCT/JP2010/053952, date of mailing Apr. 13, 2010.

* cited by examiner

*Primary Examiner* — David Walczak
*Assistant Examiner* — Bradley Oliver
(74) *Attorney, Agent, or Firm* — Westerman, Hattori, Daniels & Adrian, LLP

(57) ABSTRACT

Provided are a ballpoint pen tip which can, even if ink having properties which assures that the amount of supply of the ink to the pen tip by shear of a writing ball is sufficient is adopted, prevent partially faint written traces from occurring and provide smooth writing, a ballpoint pen refill, a ballpoint pen, and a method of manufacturing a ballpoint pen tip. A triangular pyramid-shaped recess (42) gradually tapered toward an ink guide hole (36) is provided in the bottom of a ball housing (31), and troughs (44) formed in the recess (42) are utilized as ink reservoirs and ink paths. Because the troughs (44) have sufficient length, width, and depth, the amount of containment of the ink and the amount of supply of the ink are increased. Also, even if ink which is supplied to the pen point mainly by shear of a writing ball (2A) is adopted, the supply of the ink to the pen point is not interrupted, the occurrence of partially faint written traces of ink is sufficiently prevented, and friction between the writing ball and a ball receiving seat surface can be reduced.

5 Claims, 8 Drawing Sheets

BALLPOINT PEN TIP, BALLPOINT PEN REFILL, BALLPOINT PEN, AND METHOD OF MANUFACTURING BALLPOINT PEN TIP

TECHNICAL FIELD

The present invention relates to a ballpoint pen tip in which a writing ball for transferring ink attached to a surface thereof to a writing object is provided at a tip, a ballpoint pen refill and a ballpoint pen including this ballpoint pen tip, and a method of manufacturing the ballpoint pen tip.

BACKGROUND ART

Conventionally, ballpoint pens such as oil ballpoint pens and gel ink ballpoint pens have been widely used as writing instruments. Such a ballpoint pen generally adopts a structure in which a ballpoint pen tip having a writing ball for writing is rotatably provided at a tip side thereof and an ink container containing ink is connected behind this ballpoint pen tip.

The ballpoint pen tip includes a ball housing formed as a housing space for rotatably housing the writing ball, a back hole extending from the rear end of the ballpoint pen tip to the vicinity of the ball housing, and an ink guide hole allowing the ball housing and the back hole to communicate with each other.

The ink contained in the ink container is supplied to the writing ball in the ball housing through the back hole and the ink guide hole.

Further, a ball receiving seat surface formed as a spherical surface, with which the surface of the writing ball is brought into contact, is provided around the ink guide hole on the inner surface of the ball housing. Moreover, a ball receiving seat portion is provided which receives the writing ball by this ball receiving seat surface. Furthermore, a plurality of channels are provided which extend radially outwardly from the peripheral edge of the ink guide hole to divide the ball receiving seat surface of the ball receiving seat portion, being formed to have a substantially rectangular cross sectional shape with an interval between the inner side surfaces along the extending direction.

To the surface of the writing ball, the ink is not only directly supplied from the ink guide hole, but also through the channels from the ink guide hole. In this way, the ink is simultaneously supplied to a wide range of the surface of the writing ball.

In such a ballpoint pen, a so-called "direct flow" phenomenon in which ink leaks from the pen tip is likely to occur if the ballpoint pen is left unused for a long time. To prevent this phenomenon, in some ballpoint pens, a coil spring for biasing a writing ball toward a tip side is provided in a ballpoint pen tip and a clearance between the tip of a side wall of a ball housing enclosing the writing ball and the surface of the writing ball is narrowed by pressing the writing ball toward the tip side by an elastic force of the coil spring. In this way, a cross-sectional area of an ink supply path for supplying ink to a pen tip is reduced, thereby making it more difficult for the ink to leak from the pen tip and suppressing the occurrence of the direct flow.

Further, if the depth of the channels is so set that the channels do not communicate with the back hole and the ball housing, an excessive ink transfer amount into the ball housing is prevented. This enables the direct flow to be reliably prevented by the coil spring (c.f., e.g., patent document 1).

Here, in the ballpoint pen in which the direct flow is prevented by the coil spring provided in the ballpoint pen tip, ink which is sufficiently supplied toward the pen tip side by shear of the rotating writing ball (for example, ink with a high shear thinning index (n-value)) may be adopted. In this case, if the amount of supply of the ink from the ink guide hole to the ball housing is insufficient, the ink may not be present between the ball and the ball receiving seat surface. Further, this causes problems that it becomes difficult for the ball to rotate and partially faint written traces occur during writing.

On the other hand, ballpoint pen tips such as the following (1) to (3) have been proposed to solve a problem of partially faint written traces.

Moreover, ballpoint pen tips such as (4) have been also proposed for the purpose of smoothly rotating a ball.

(1) A ball receiving seat surface formed as a concave surface corresponding to the spherical surface of a writing ball is provided around an ink guide hole in the bottom surface of a ball housing. The writing ball is received by this ball receiving seat surface. Furthermore, a ballpoint pen tip includes two types of a plurality of channels with different widths, radially extending from the ink guide hole as a center and alternately arranged in a circumferential direction. By increasing the number of these channels, a sufficient ink supply amount toward a pen tip side is assured (c.f., e.g., patent document 2).

(2) A plurality of channels radially extending from an ink guide hole as a center are provided. The cross-sectional area of ends of these channels opposite to the ink guide hole is enlarged. This increases an ink supply amount toward a pen tip side (c.f., e.g., patent document 3).

(3) A plurality of first channels radially extending from an ink guide hole as a center are provided. Moreover, second channels having shorter length and narrower width than these first channels and penetrating through a ball receiving seat portion to allow a ball housing and a back hole to communicate with each other are provided in the bottom surfaces of these first channels. By providing these second channels, flow resistance in an ink supply path for supplying ink to a pen tip is reduced to increase an ink supply amount toward a pen tip side (c.f., e.g., patent document 4).

(4) A plurality of channels radially extending from an ink guide hole as a center are provided. Ink is supplied to a ball receiving seat surface also by communication among these channels, thereby increasing an ink supply amount to the ball receiving seat surface, and the ball receiving seat surface is easily enlarged by this increase in the ink supply amount. In this way, a degree of freedom in setting the area of the ball receiving seat surface with respect to a writing ball is increased to adjust the area of the ball receiving seat surface, whereby defective rotation of the writing ball is prevented to consequently ensure smooth rotation of the writing ball (c.f., e.g., patent document 5).

PRIOR ART DOCUMENTS

Patent Documents

Patent document 1: JP 10-193863 A
Patent document 2: JP 2006-289807 A
Patent document 3: JP 2009-6636 A
Patent document 4: JP 2009-6637 A
Patent document 5: JP 2002-321485 A

SUMMARY OF INVENTION

Problems to be Solved by the Invention

In the above ballpoint pens (1) to (4), the occurrence of partially faint written traces cannot be sufficiently prevented in the case of adopting ink which is sufficiently supplied toward the pen tip side by shear of the rotating writing ball. Thus, there is a request to sufficiently prevent the occurrence of partially faint written traces even in the case of adopting such ink.

Note that, in the above ballpoint pens (1) to (3), the number of the channels may be increased or the size of the channels may be simply enlarged to sufficiently prevent the occurrence of partially faint written traces. However, this causes a problem that the direct flow cannot be prevented even if a measure such as provision of the coil spring is taken.

Moreover, in the ballpoint pen (4), the ink supply amount toward a radially outer side of the ball receiving seat surface can be increased by providing the channels radially extending with respect to the annular ball receiving seat surface. However, it is difficult to increase the ink supply amount toward a radially inner side of the ball receiving seat surface. Thus, when the area of the ball receiving seat surface is increased, the supply of the ink to the radially inner part of the ball receiving seat surface may be insufficient. Accordingly, defective rotation of the writing ball cannot necessarily be prevented. Therefore, there is a problem of being unable to ensure smooth writing.

Particularly, this tendency is notable in ballpoint pen tips including a writing ball with a large diameter.

Accordingly, the present invention was developed in view of the problems inherent in the above background art. An object of the present invention is to provide a ballpoint pen tip, a ballpoint pen refill, a ballpoint pen and a method of manufacturing the ballpoint pen tip, which can sufficiently prevent partially faint written traces and ensure smooth writing even if ink having properties which assure that the amount of supply of the ink to a pen tip by shear of a writing ball is sufficient is adopted.

Means to Solve the Problems

The respective aspects of the invention have been made in order to achieve the above object.

First Aspect

The first aspect of the present invention is directed to a ballpoint pen tip comprising a writing ball for transferring ink attached to a surface thereof to a writing object and a holder having this writing ball rotatably provided at a tip;

the holder being provided with:

a ball housing formed as a housing space for rotatably housing the writing ball, a back hole extending from the rear end of the holder to the vicinity of the ball housing, and an ink guide hole allowing the ball housing and the back hole to communicate with each other;

a recess gradually tapered toward the ink guide hole being formed in the bottom of the ball housing;

the recess being provided with:

a plurality of inclined surfaces inclined downwardly toward the ink guide hole, and a plurality of troughs formed in parts where these inclined surfaces intersect and extending radially from the ink guide hole;

each of the inclined surfaces being formed with a ball receiving seat surface composed of a concave surface corresponding to the spherical surface of the writing ball to receive the writing ball; and each of the ball receiving seat surfaces being formed with an arcuately curved peripheral edge.

Second Aspect

According to the second aspect of the present invention, in the above first aspect of the present invention, the recess is formed with three inclined surfaces inclined downwardly toward the ink guide hole.

Third Aspect

The third aspect of the present invention is directed to a ballpoint pen refill comprising a ballpoint pen tip comprising a writing ball for transferring ink attached to a surface thereof to a writing object and a holder having this writing ball rotatably provided at a tip;

the holder being provided with:

a ball housing formed as a housing space for rotatably housing the writing ball, a back hole extending from the rear end of the holder to the vicinity of the ball housing, and an ink guide hole allowing the ball housing and the back hole to communicate with each other;

a recess gradually tapered toward the ink guide hole being formed in the bottom of the ball housing;

the recess being provided with:

a plurality of inclined surfaces inclined downwardly toward the ink guide hole, and a plurality of troughs formed in parts where these inclined surfaces intersect and extending radially from the ink guide hole;

each of the inclined surfaces being formed with a ball receiving seat surface composed of a concave surface corresponding to the spherical surface of the writing ball to receive the writing ball; and each of the ball receiving seat surfaces being formed with an arcuately curved peripheral edge.

Fourth Aspect

The fourth aspect of the present invention is directed to a ballpoint pen comprising ballpoint pen tip comprising a writing ball for transferring ink attached to a surface thereof to a writing object and a holder having this writing ball rotatably provided at a tip;

the holder being provided with:

a ball housing formed as a housing space for rotatably housing the writing ball, a back hole extending from the rear end of the holder to the vicinity of the ball housing, and an ink guide hole allowing the ball housing and the back hole to communicate with each other;

a recess gradually tapered toward the ink guide hole being formed in the bottom of the ball housing;

the recess being provided with:

a plurality of inclined surfaces inclined downwardly toward the ink guide hole, and a plurality of troughs formed in parts where these inclined surfaces intersect and extending radially from the ink guide hole;

each of the inclined surfaces being formed with a ball receiving seat surface composed of a concave surface corresponding to the spherical surface of the writing ball to receive the writing ball; and each of the ball receiving seat surfaces being formed with an arcuately curved peripheral edge.

Fifth Aspect

The fifth aspect of the present invention is directed to a manufacturing method of a ballpoint pen tip comprising a writing ball for transferring ink attached to a surface thereof to a writing object and a holder having this writing ball rotatably provided at a tip; the holder being provided with a ball housing formed as a housing space for rotatably housing the writing ball, a back hole extending from the rear end of the holder to the vicinity of the ball housing, and an ink guide hole allowing the ball housing and the back hole to communicate with each other; comprising:

a pressing step, after the ball housing is formed at a tip end part of the holder by cutting, in which a polygonal pyramid-shaped recess is formed by pressing a pointed tip of a polygonal pyramid-shaped pin, which has a plurality of inclined surfaces tapered toward the tip and is formed with ridges at the intersections of these inclined surfaces, toward the bottom of the ball housing to indent the bottom of the ball housing by the pin;

a narrowing step following the pressing step in which, after the writing ball is inserted into the ball housing formed with the recess in the pressing step, the tip of a side wall of the ball housing enclosing the writing ball is narrowed so that the writing ball does not come out of the ball housing; and a hitting step following the narrowing step in which, in a condition that the writing ball is inserted in the ball housing formed with the recess in the pressing step, a ball receiving seat portion composed of concave surfaces corresponding to the spherical surface of the writing ball is formed by hitting the writing ball to indent the inclined surfaces of the recess by the writing ball.

Effects of Invention

Effects of the First, Third and Fourth Aspects

The first, third and fourth aspects of the present invention configured as above achieve such effects as described below.

That is, according to the first, third and fourth aspects of the present invention, the recess gradually tapered toward the ink guide hole is formed in the bottom of the ball housing. This recess is provided with the plurality of inclined surfaces inclined downwardly toward the ink guide hole and the plurality of troughs formed in the parts where these inclined surfaces intersect and extending radially from the ink guide hole. Furthermore, each of the plurality of inclined surfaces of this recess is formed with the ball receiving seat surface composed of the concave surface corresponding to the spherical surface of the writing ball to receive the writing ball. Thus, sufficient width and depth are ensured for the troughs adjacent to the ball receiving seat surfaces that receive the writing ball. Furthermore, if the ink is allowed to flow from the ink guide hole to the writing ball through these troughs, the amount of supply of the ink also increases.

Since such troughs are adjacent to the ball receiving seat surfaces receiving the writing ball, the ink is uninterruptedly supplied to the peripheral edges of the ball receiving seat surfaces from the troughs when the rotating writing ball shears the ink at the arcuately curved peripheral edges of the ball receiving seat surfaces.

In this way, even if ink which is supplied to the pen tip by shear by the writing ball is adopted, the supply of the ink to the pen tip is not interrupted and the occurrence of partially faint written traces can be sufficiently prevented.

Furthermore, since the ball receiving seat surfaces are not uniformly identically shaped all along the outer peripheral edge of the ink guide hole unlike conventional ballpoint pen tips, the area of each trough can be freely designed while the volume thereof is suppressed to a minimum level. Thus, by arbitrarily setting this area depending on the use or the like of the ballpoint pen tip, a coefficient of friction between the writing ball and a ball receiving seat surface during writing is reduced and, furthermore, resistance to direct flow of ink at the time of not writing is improved.

Effects of the Second Aspect

Moreover, the second aspect of the present invention achieves such effects as described below.

That is, according to the second aspect of the present invention, the recess in the bottom of the ball housing is formed with the three inclined surfaces inclined downwardly toward the ink guide hole. Thus, the writing ball rotatably housed in the ball housing is supported at three sides, accommodates at a predetermined position in the ball housing even during writing and smoothly rotates.

This does not cause the rotation of the writing ball to be stopped even instantaneously during writing. Thus, it is prevented that the supply of the ink is interrupted due to the rotation stop of the writing ball when the ink on the surface of the writing ball is transferred to a writing surface while the writing ball is rotated. Also in this respect, partially faint written traces of the ink can be prevented.

Effects of the Fifth Aspect

Moreover, the fifth aspect of the present invention achieves such effects as described below.

That is, according to the fifth aspect of the present invention, the pressing step of indenting the bottom of the ball housing is performed by pressing the pointed tip of the polygonal pyramid-shaped pin toward the bottom of the ball housing. Thus, the recess gradually tapered toward the ink guide hole can be formed in the bottom of the ball housing by this pressing step. In addition, this recess can be provided with the plurality of inclined surfaces inclined downwardly toward the ink guide hole and the plurality of troughs extending radially from the ink guide hole.

Incidentally, with a conventional processing method, burrs are produced around the ink guide hole if grooves are formed around the ink guide hole by cutting. Thus, a step of removing the burrs is required. On the contrary, in the present invention, no burrs are produced since such cutting as to produce burrs is not performed. Therefore, the step of removing the burrs can be omitted.

When the narrowing step of narrowing the tip of the side wall of the ball housing enclosing the writing ball is subsequently performed with the writing ball inserted in the ball housing, the writing ball inserted in the ball housing can be retained by this narrowing step.

Moreover, when the hitting step of hitting the writing ball to indent the inclined surfaces of the ball housing by the writing ball is performed with the writing ball inserted in the ball housing, the ball receiving seat surfaces composed of the concave surfaces corresponding to the spherical surface of the writing ball can be formed by this hitting step. Moreover, by performing the pressing step, the narrowing step and the hitting step as described above, the ballpoint pen tip can be formed with the recess, the inclined surfaces, the troughs and the ball receiving seat surfaces. In this way, the ballpoint pen tip capable of preventing partially faint written traces of the ink can be obtained.

BEST MODE FOR CARRYING OUT THE INVENTION

Hereinafter, one embodiment as a best mode for carrying out the present invention is described with reference to the drawings. Note that, in this specification, a tip in a writing instrument is an end to be brought into contact with a writing object such as a sheet out of both ends of a shaft tube. Moreover, the end opposite to this is referred to as a rear end in the writing instrument.

(Schematic Construction of Ballpoint Pen 1)

Figure 1:
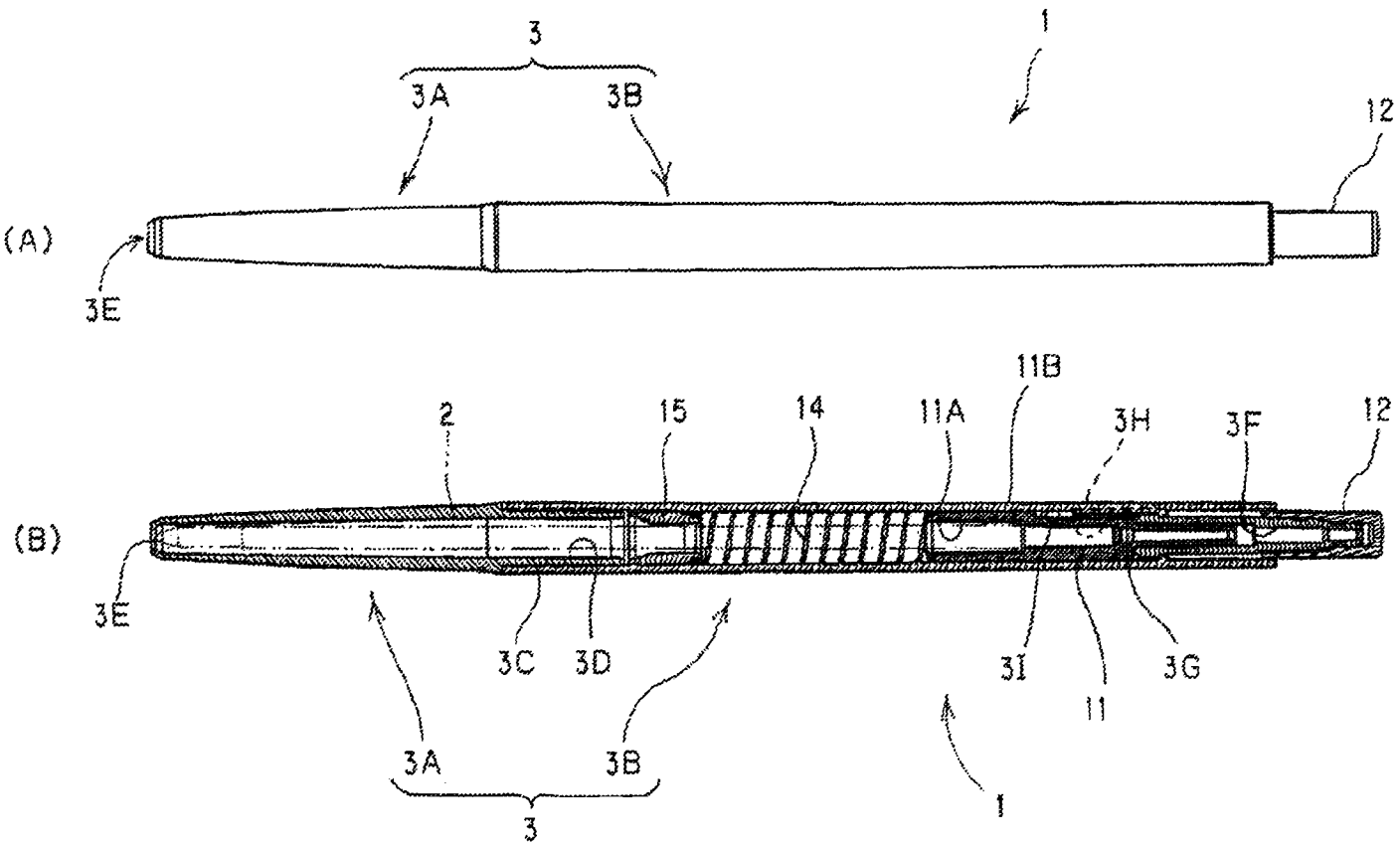
FIG. 1 A front view (A) and a sectional view (B) showing a ballpoint pen according to one embodiment of the present invention.

A ballpoint pen 1 according to the first embodiment includes a ballpoint pen refill 2 and a shaft tube 3 for housing this ballpoint pen refill 2 inside as shown in FIG. 1.

(Shaft Tube 3)

The shaft tube 3 is formed by separably connecting a tapered front shaft portion 3A which is a member arranged on the left side in FIG. 1 and a rear shaft portion 3B arranged on the right side in FIG. 1.

As shown in FIG. 1B, an external thread portion 3C is formed on the outer peripheral surface of a side of the front shaft portion 3A near the rear shaft portion 3B.

An internal thread portion 3D threadably engageable with this external thread portion 3C is formed on the inner peripheral surface of a side of the rear shaft portion 3B near the front shaft portion 3A.

The front shaft portion 3A and the rear shaft portion 3B are connected to each other by threadable engagement of the external thread portion 3C and the internal thread portion 3D and, furthermore, separable by threadably disengaging the external thread portion 3C and the internal thread portion 3D.

A tip opening 3E, from which the tip of a writing body projects, is provided at a tip part of the front shaft portion 3A.

An opening 3F, into which a rear end part of a button 12 to be clicked is inserted, is provided at a rear end part of the rear shaft portion 3B.

Moreover, a rotor 11 for keeping the tip of the writing body projected from the tip opening 3E of the shaft tube 3 by a clicking operation in a projecting state, the button 12 to be clicked to cause the tip of the writing body to project from the tip opening 3E of the shaft tube 3, and a coil spring 14 for biasing the rotor 11 toward the rear end side are provided in the rear shaft portion 3B.

The rotor 11 is a substantially cylindrical part and includes a key 11B projecting radially outwardly from the outer peripheral surface of the rotor.

An opening at a tip side of such a rotor 11 serves as a recess 11A. By fitting a rear end part of the ballpoint pen refill 2 into this recess 11A, the rotor 11 is connected to this ballpoint pen refill 2.

On the other hand, the inner peripheral surface of the rear shaft portion 3B is provided with a plurality of guide ribs 3G projecting radially inwardly from this inner peripheral surface and extending in a longitudinal direction of the rear shaft portion 3B, and a plurality of guide grooves 3H formed between these guide ribs 3G and extending in the longitudinal direction of the rear shaft portion 3B.

Ends at tip sides of the plurality of guide ribs 3G are arranged at the same position in the longitudinal direction of the rear shaft portion 3B. Further, guiding inclined surfaces 31 inclined in the same direction are provided at the respective ends at the tip sides of these guide ribs 3G.

The respective plurality of guide grooves 3H are for guiding the key 11B of the rotor 11 having moved thereinto in the longitudinal direction of the rear shaft portion 3B.

The ends at the tip sides of these guide grooves 3H are arranged at the same position in the longitudinal direction of the rear shaft portion 3B. Further, the guide grooves 3H come in two types having different lengths in the longitudinal direction of the rear shaft portion 3B. The longer guide grooves 3H and the shorter guide grooves 3H are alternately provided in a circumferential direction.

The button 12 is so formed that a rear end part projects and retracts from and into the opening 3F of the rear shaft portion 3B with a tip end part retracted in the rear shaft portion 3B.

The coil spring 14 is housed while being compressed in the rear shaft portion 3B. That is, a spring receiving tube 15 formed to have a tubular shape and having an outer diameter substantially equal to the inner diameter of the rear shaft portion 3B is press-fitted near the tip of the rear shaft portion 3B.

The coil spring 14 is interposed in a compressed state between the rear end edge of the spring receiving tube 15 and the tip edge of the rotor 11 and biases the rotor 11 and the button 12 toward the rear end side by an elastic force generated by this.

Here, with the key 11B of the rotor 11 housed in the longer guide groove 3H, the tip of the ballpoint pen refill 2 is pulled in the tip opening 3E of the shaft tube 3.

Further, when a pressing force is applied to the button 12 to press the button 12 toward the tip side against the elastic force of the coil spring 14 with the tip of the ballpoint pen refill 2 housed in the tip opening 3E, the button 12 moves the rotor 11 toward the tip side. In this way, the tip of the ballpoint pen refill 2 projects from the tip opening 3E.

When the button 12 is completely pressed toward the tip side, the key 11B of the rotor 11 moves toward the tip side with respect to the end of the longer guide groove 3H to come out of the longer guide groove 3H.

Thereafter, when the button 12 is released from the applied pressing force, the rotor 11 and the button 12 start moving toward the rear end side by the elastic force of the coil spring 14.

The key 11B of the rotor 11 rotates by being guided by the guiding inclined surface 31 provided at the tip end of the guide rib 3G when the rotor 11 moves toward the rear end side.

By this rotation of the rotor 11, the key 11B enters the interior of the shorter guide groove 3H arranged adjacent to the longer guide groove 3H, in which the key 11*b* was located before the clicking operation.

In this way, the ballpoint pen refill 2 is maintained in a state where the tip projects from the tip opening 3E of the shaft tube 3, so that writing by the ballpoint pen refill 2 is possible.

Further, after writing is finished, the tip of the ballpoint pen refill 2 is retracted into the tip opening 3E of the shaft tube 3 by clicking the button 12 again.

That is, when the clicking operation is performed in the state where the tip of the ballpoint pen refill 2 is projecting from the tip opening 3E of the shaft tube 3, the key 11B comes out of the shorter guide groove 3H, in which the key 11B was located before the clicking operation, by the rotation of the rotor 11 and enters the interior of the longer guide groove 3H arranged adjacent thereto. This makes the ballpoint pen refill 2 move toward the rear end side of the shaft tube 3 by the elastic force of the coil spring 14, whereby the tip is retracted into the tip opening 3E.

(Ballpoint Pen Refill 2)

Figure 2:
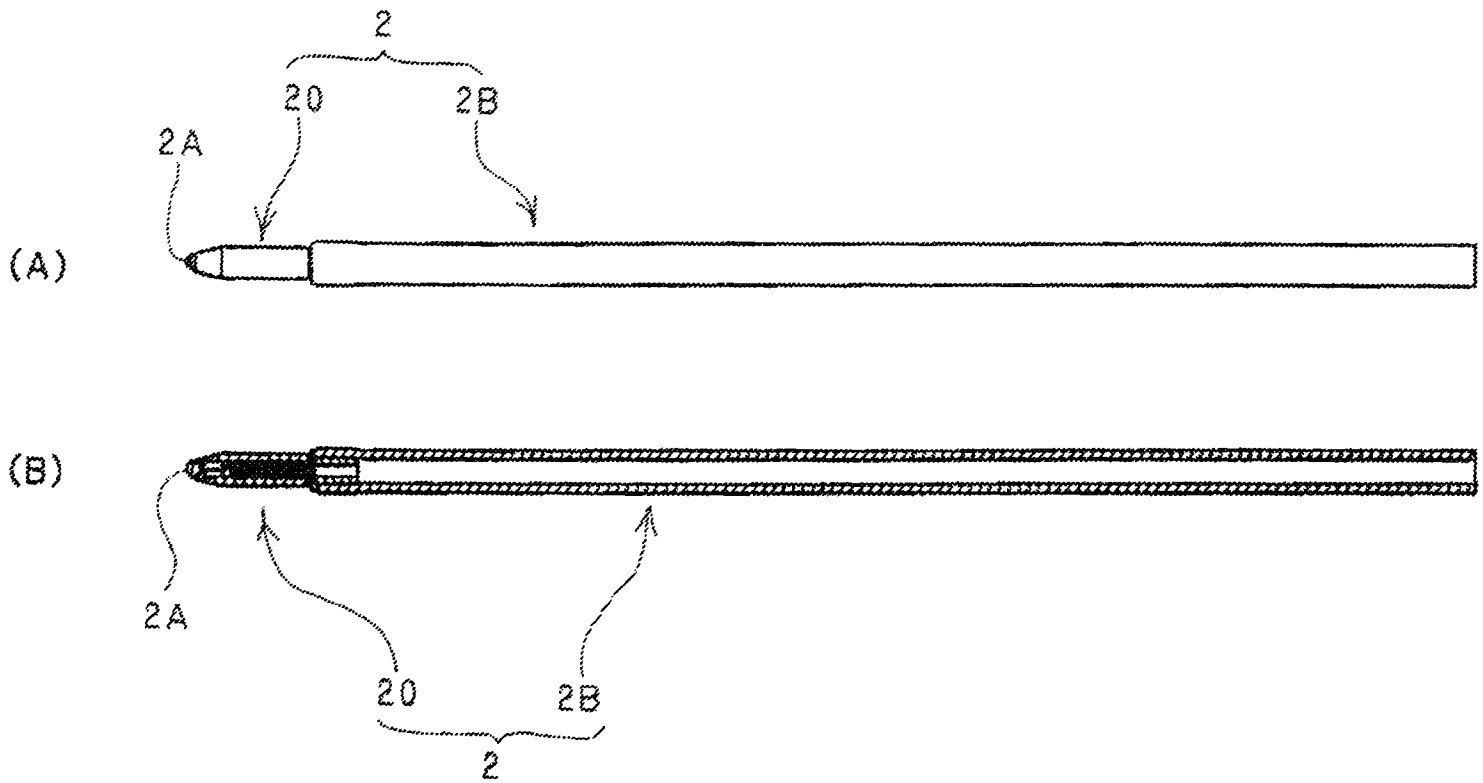
FIG. 2 A front view (A) and a sectional view (B) showing a ballpoint pen refill according to the embodiment.

As shown in FIG. 2, the ballpoint pen refill 2 includes a ballpoint pen tip 20 having a writing ball 2A rotatably provided at its tip, and a pipe-like tubular body 2B containing ink for writing used at this ballpoint pen tip 20 inside.

(Ballpoint Pen Tip 20)

Figure 3:
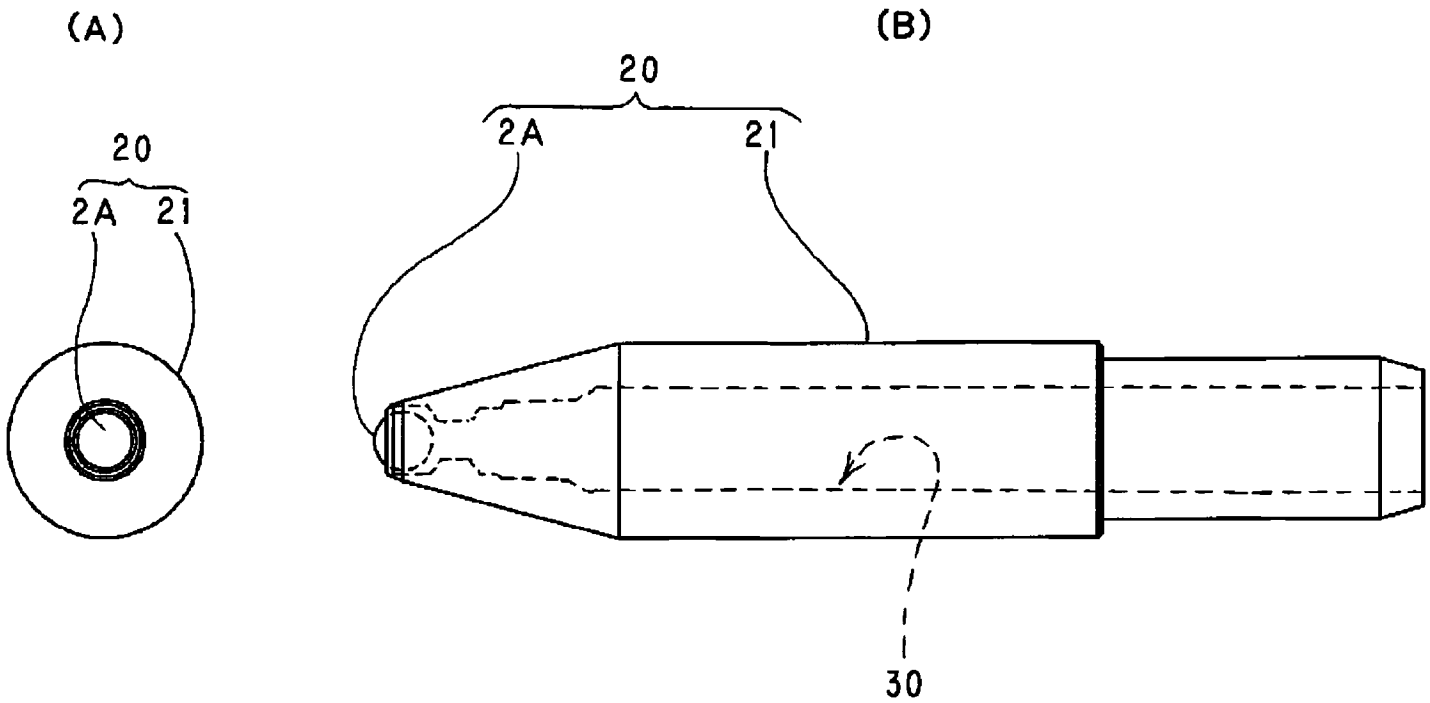
FIG. 3 A plan view (A) and a front view (B) showing a ballpoint pen tip according to the embodiment.

As shown in FIG. 3, the ballpoint pen tip 20 includes the above-mentioned writing ball 2A arranged at the tip thereof and adapted to transfer the ink attached to the surface to a writing object, and a holder 21 for rotatably holding this writing ball 2A.

The writing ball 2A is a spherical body formed by processing a hard metal such as cemented carbide into a spherical shape to ensure sufficient abrasion resistance and the like.

Figure 4:
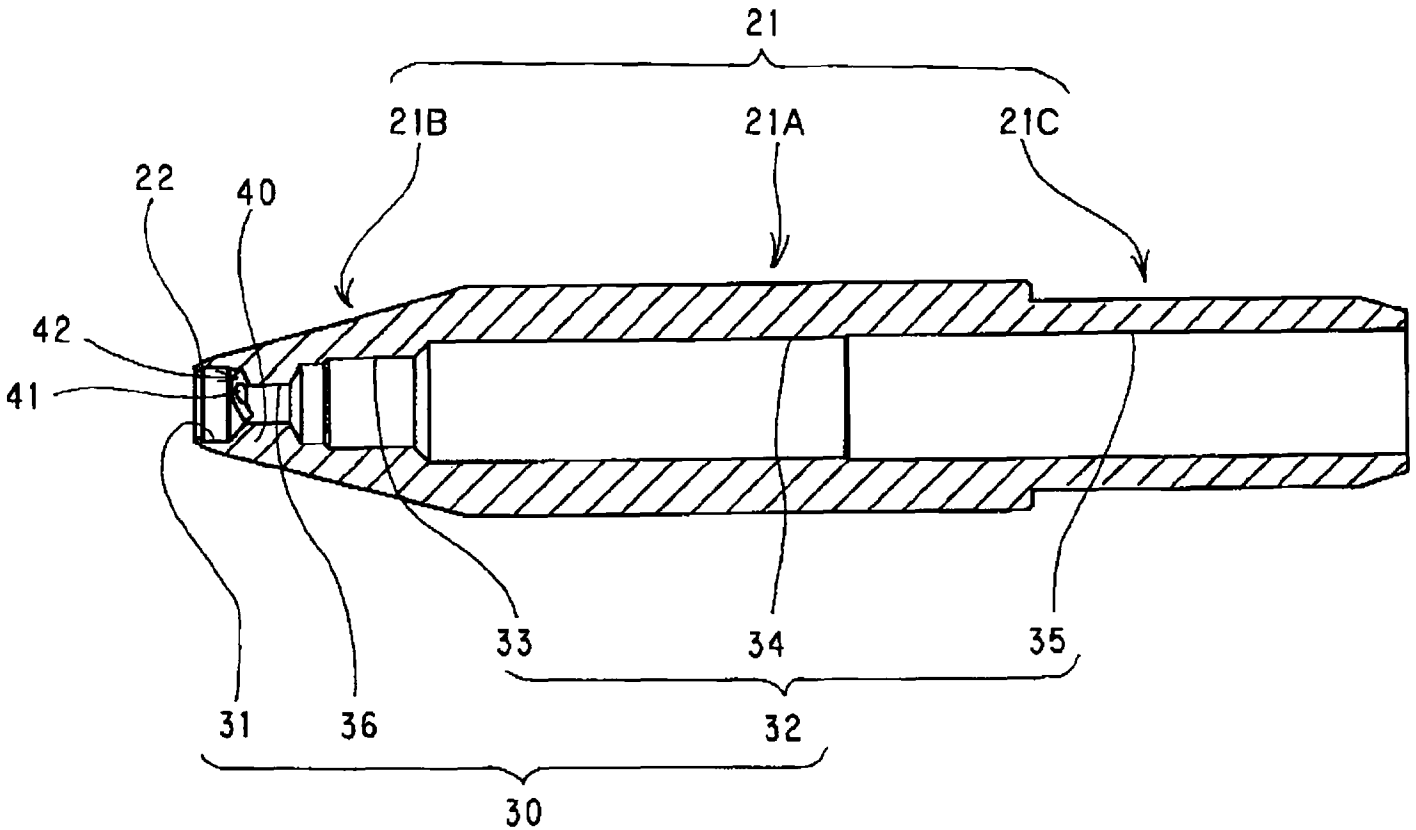
FIG. 4 A sectional view showing a holder according to the embodiment (however, a writing ball is omitted).
Figure 5:
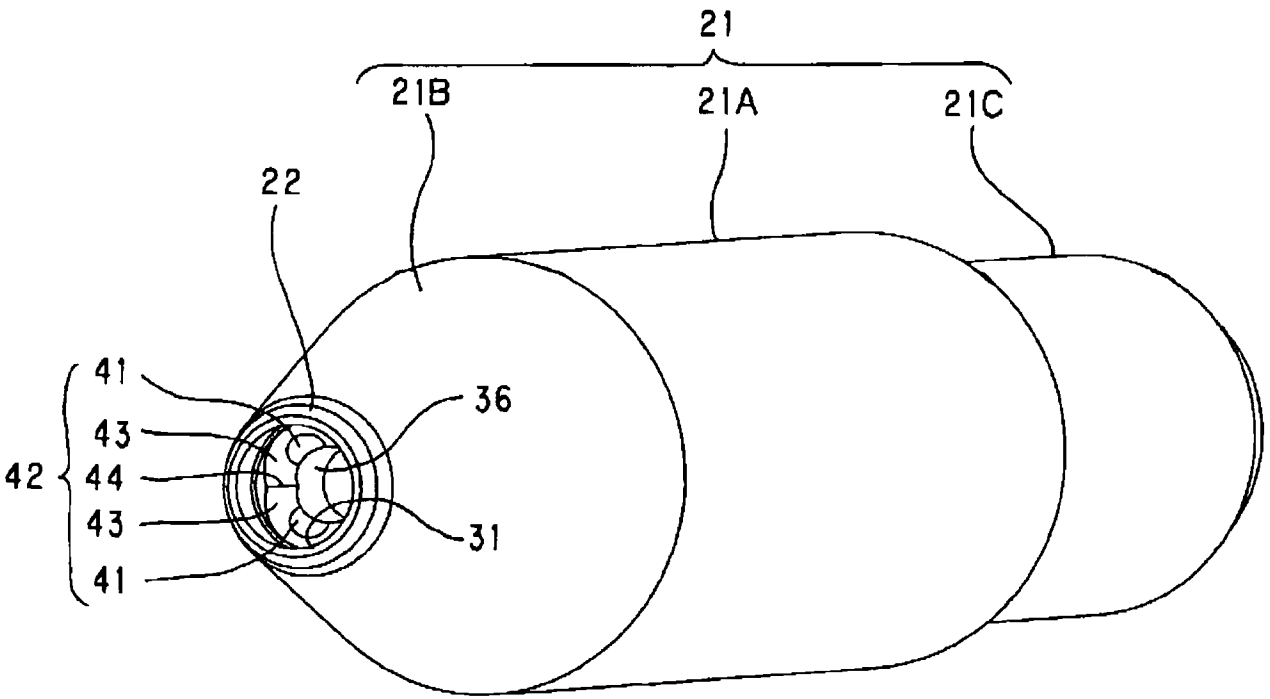
FIG. 5 A perspective view showing the holder according to the embodiment (however, the writing ball is omitted).

As shown in FIGS. 4 and 5, the holder 21 is formed with a hollow portion 30 penetrating entirely from the tip to the rear end. A substantially central part thereof is a pipe portion 21A formed into a cylindrical shape. A taper portion 21B tapered toward the tip is formed at a tip side of this pipe portion 21A. Moreover, a reduced diameter portion 21C having a smaller outer diameter than the pipe portion 21A is formed at a rear end side of the pipe portion 21A.

The holder 21 is connected to a tip end part of the tubular body 21C by fitting the reduced-diameter portion 21C into the pipe-like tubular body 2B.

Here, as shown in FIG. 4, a ball housing 31 which is a housing space for rotatably housing the writing ball 2A is formed as a part of the hollow portion 30 in a tip end part of the holder 21.

Moreover, a back hole 32 extending from the rear end of the holder 21 to the vicinity of the ball housing 31 is formed as a part of the hollow portion 30 in a rear end part of the holder 21. This back hole 32 communicates with the interior of the tubular body 2B to serve as a space for introducing the ink contained in the tubular body 2B to the inside.

Note that the back hole 32 includes a small-diameter portion 33, a first large-diameter portion 34 and a second large-diameter portion 35 having different inner diameters.

Out of these, the small-diameter portion 33 having the smallest inner diameter is formed in the taper portion 21B.

The first large-diameter portion 34 having the inner diameter larger than the small-diameter portion 33 is mostly formed in the pipe portion 21A and the tip thereof slightly sticks out into the taper portion 21B.

The second large-diameter portion 35 having the inner diameter slightly larger than the first large-diameter portion 34 is formed to lie astride both the pipe portion 21A and the reduced-diameter portion 21C.

Furthermore, an ink guide hole 36 which allows the ball housing 31 and the back hole 32 to communicate with each other is formed as a part of the hollow portion 30 in the holder 21.

The tip end part of the holder 21 is a narrowed portion 22 which is so folded as to cover the surface of the writing ball 2A as shown in FIG. 4. This narrowed portion 22 serves as a retainer for preventing the writing ball 2A housed in the ball housing 31 from coming out of the ball housing 31.

Further, a side wall part formed around the ink guide hole 36 projects radially inwardly from the inner peripheral surface of the small-diameter portion 33 of the back hole 32 so that the writing ball 2A does not move any further backward toward the back hole 32, thereby serving as a ball receiving seat portion 40 for receiving the writing ball 2A.

The ball receiving seat 40 forms the bottom of the ball housing 31 as shown in FIG. 4. This ball receiving seat 40 is formed with ball receiving seat surfaces 41 held in contact with the surface of the writing ball 2A and the writing ball 2A is received by these ball receiving seat surfaces 41.

Note that the ball receiving seat surfaces 41 are formed by hitting the writing ball 2A housed in the ball housing 31 from a pen tip side to indent the bottom surface of the ball housing 31. Thus, the ball receiving seat surfaces 41 are not present unless the writing ball 2A is housed in the ball housing 31, but FIGS. 4 to 6 show the holder 21 with the writing ball 2A, which should be located therein, omitted to facilitate the description.

Next, the bottom of the ball housing 31 where the ball receiving seat 40 is formed is described in detail.

As shown in FIG. 4, a recess 42 gradually tapered toward the ink guide hole 36, specifically having a polygonal pyramid shape and tapered toward the ink guide hole 36 is formed in the bottom of the ball housing 31.

Figure 6:
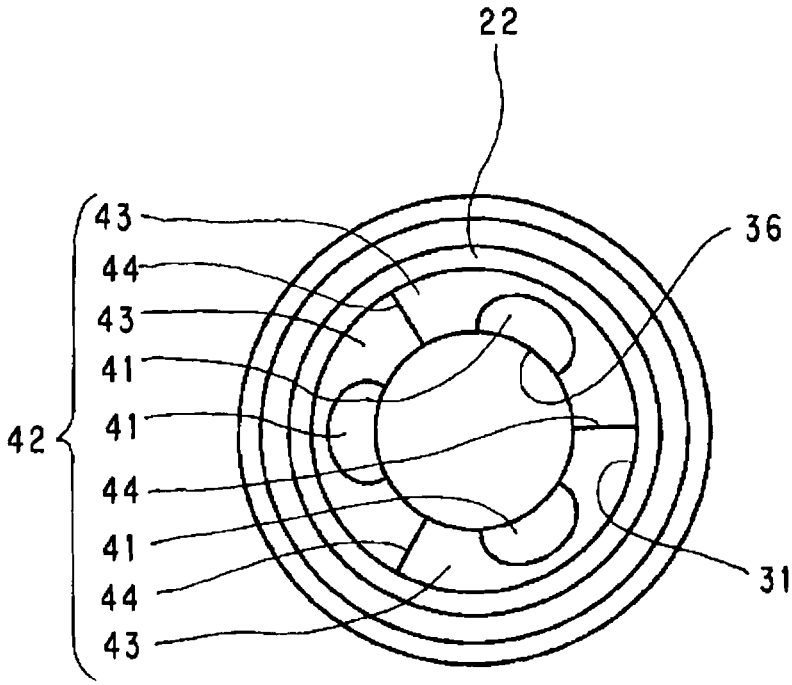
FIG. 6 A plan view showing a recess according to the embodiment (however, the writing ball is omitted).

This recess 42 includes a plurality of inclined surfaces 43 inclined downwardly toward the ink guide hole 36 as shown in FIG. 5 and a plurality of troughs 44 formed in parts where these inclined surfaces 43 intersect and extending radially from the ink guide hole 36 as shown in FIGS. 5 and 6.

The above ball receiving seat surface 41 is formed in each of the plurality of inclined surfaces 43 provided in the recess 42. In other words, each of the plurality of inclined surfaces 43 is formed with the ball receiving seat surface 41 composed of a concave surface corresponding to the spherical surface of the writing ball 2A to receive the writing ball 2A.

Here, the recess 42 is formed with three inclined surfaces 43 as shown in FIG. 6, and these inclined surfaces 43 are inclined downwardly toward the ink guide hole 36. This makes the recess 42 a triangular pyramid-shaped recess.

Each of these inclined surfaces 43 is convex surfaces slightly bulging toward the interior of the ball housing 31. Further, the ball receiving seat surfaces 41 composed of concave surfaces are formed at center positions of the respective inclined surfaces 43 in the circumferential direction.

Note that, although the inclined surfaces 43 are convex surfaces in this embodiment, they may be flat surfaces. In short, the inclined surfaces 43 may be either convex surfaces or flat surfaces as long as the troughs 44 having a sufficiently large cross section are formed in parts where two inclined surfaces intersect.

Moreover, each of the ball receiving seat surfaces 41 formed on the respective inclined surfaces 43 is formed with an arcuately curved peripheral edge.

That is, the peripheral edge of each ball receiving seat surface 41 facing the ink guide hole 36 is inwardly concave and arcuately curved.

On the other hand, a peripheral edge of each ball receiving seat surface 41 in contact with the inclined surface 43 is outwardly convex and arcuately curved.

(Manufacturing Procedure of Ballpoint Pen Tip 20)

Next, a manufacturing procedure of the ballpoint pen tip 20 according to this embodiment is briefly described. The ballpoint pen tip 20 of this embodiment can be manufactured by successively performing the following steps (1) to (4).

(1) A cutting step is performed by, after the pipe portion 21A, the taper portion 21B and the reduced-diameter portion 21C of the holder 21 are formed by cutting, forming the ink guide hole 36 and the back hole 32 in the holder 21 and, thereafter, forming the ball housing 31 in the tip end part of the holder 21 by cutting.

(2) The bottom of the ball housing 31 formed in the tip end part of the holder 21 is pressed using an unillustrated triangular pyramid-shaped pin as a pressing tool.

That is, the triangular pyramid-shaped pin adopted has three inclined surfaces tapered toward its tip and is formed with ridges at the intersections of these inclined surfaces. Further, a pressing step of indenting the bottom of the ball housing 31 using the pin is performed by pressing the pointed tip of this pin toward the bottom of the ball housing 31.

Figure 7:
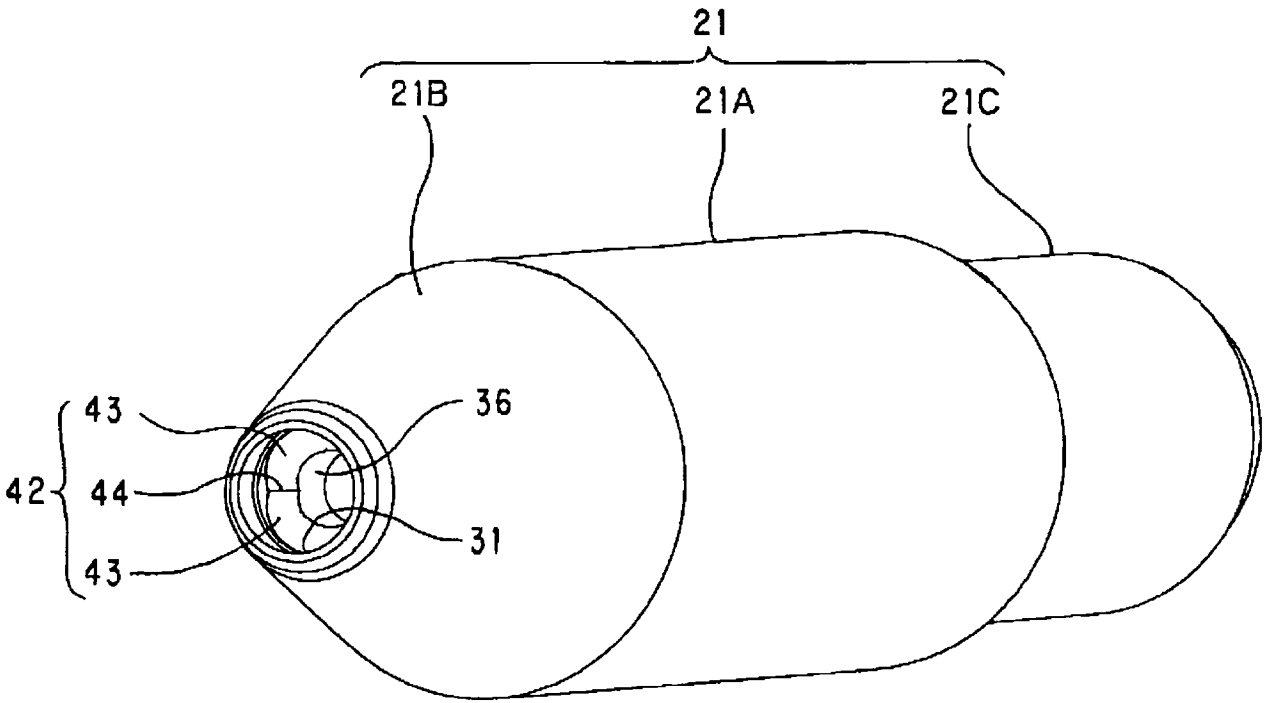
FIG. 7 A perspective view showing the holder after a pressing step according to the embodiment.
Figure 8:
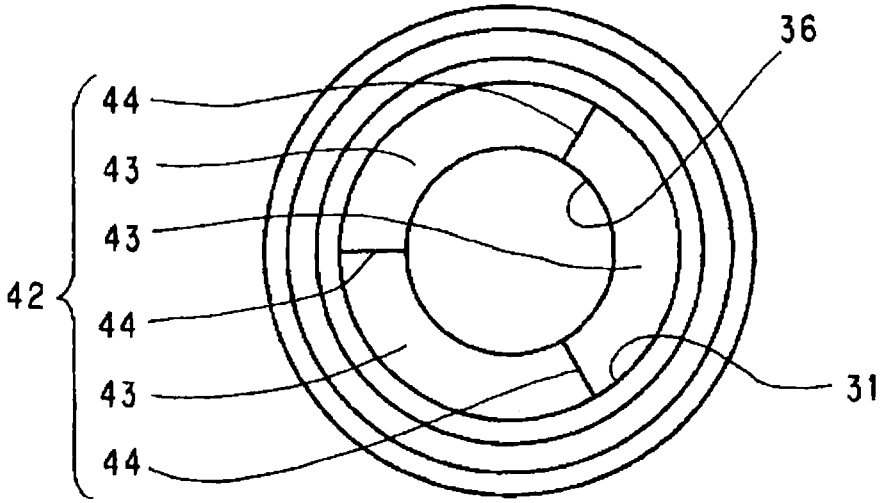
FIG. 8 A plan view showing the recess after the pressing step according to the embodiment.

By this pressing step, the triangular pyramid-shaped recess 42 is formed in the holder 21 as shown in FIG. 7. Further, this recess 42 is formed with three inclined surfaces 43 and three troughs 44 as shown in FIG. 8.

(3) A narrowing step is performed by inserting the writing ball 2A into the ball housing 31 formed with the recess 42 in the pressing step, and narrowing the tip of the side wall of the ball housing 31 enclosing the writing ball 2A so that this writing ball 2A does not come out of the ball housing 31.

(4) A hitting step is performed by hitting the writing ball 2A inserted in the ball housing 31 formed with the recess 42 in the pressing step from the tip side to indent the inclined surfaces 43 of the recess 42 by the writing ball 2A, whereby the inclined surfaces 43 are formed with the ball receiving seat surfaces 41 composed of concave surfaces corresponding to the spherical surface of the writing ball 2A.

According to this embodiment as described above, the following effects are achieved.

That is, the recess 42 gradually tapered toward the ink guide hole 36 is formed in the bottom of the ball housing 31. Moreover, this recess 42 includes the plurality of inclined surfaces 43 inclined downwardly toward the ink guide hole 36 and the plurality of troughs 44 formed in the parts where these inclined surfaces 43 intersect and extending radially from the ink guide hole 36. Furthermore, each of the plurality of inclined surfaces 43 is formed with the ball receiving seat surface 41 composed of the concave surface corresponding to the spherical surface of the writing ball 2A to receive the writing ball 2A. Thus, sufficient length, width and depth are ensured for the troughs 44 adjacent to the ball receiving seat surfaces 41 for receiving the writing ball 2A. When the ink is contained in these troughs 44, the amount of containment of the ink is increased. In addition, when the ink is allowed to flow from the ink guide hole 36 to the writing ball 2A through these troughs 44, the amount of supply of the ink is also increased.

Since such troughs 44 are adjacent to the ball receiving seat surfaces 41 receiving the writing ball 2A, the ink is uninterruptedly supplied to the peripheral edges of the ball receiving seat surfaces 41 from the troughs 44 when the rotating writing ball 2A shears the ink at the arcuately curved peripheral edges of the ball receiving seat surfaces 41.

In this way, even if ink which is supplied to the pen tip mainly by shear by the writing ball 2A is adopted, the supply of the ink to the pen tip is not interrupted, the occurrence of partially faint written traces can be sufficiently prevented and smooth writing can be obtained.

Moreover, since the three inclined surfaces 43 inclined downwardly toward the ink guide hole 36 are formed in the recess 42 in the bottom of the ball housing 31, the writing ball 2A rotatably housed in the ball housing 31 is supported at three sides, accommodates at a predetermined position in the ball housing 31 even during writing and smoothly rotates.

Since this does not cause the rotation of the writing ball 2A to be stopped even instantaneously during writing, it is prevented that the supply of the ink is interrupted due to the rotation stop of the writing ball 2A when the ink on the surface of the writing ball 2A is transferred to a writing surface while the writing ball 2A is rotated. Therefore, also in this respect, partially faint written traces of the ink can be prevented and smooth writing can be obtained.

Furthermore, the pressing step of indenting the bottom of the ball housing 31 is performed by pressing the pointed tip of the triangular pyramid-shaped pin toward the bottom of the ball housing 31. In this pressing step, the recess 42 gradually tapered toward the ink guide hole 36 can be formed in the bottom of the ball housing 31. In addition, this recess 42 can be provided with the three inclined surfaces 43 inclined downwardly toward the ink guide hole 36 and the three troughs 44 extending radially from the ink guide hole 36.

Subsequently, the narrowing step is performed to form the narrowed portion 22 by narrowing the tip of the side wall of the ball housing 31 enclosing the writing ball 2A with the writing ball 2A inserted in the ball housing 31. Thus, the writing ball 2A inserted in the ball housing 31 can be retained by this narrowing step.

Moreover, the hitting step is performed to indent the inclined surfaces 43 of the ball housing 31 by the writing ball 2A by hitting the writing ball 2A with the writing ball 2A inserted in the ball housing 31. Thus, in this hitting step, the ball receiving seat surfaces 41 composed of the concave surfaces corresponding to the spherical surface of the writing ball 2A can be reliably formed. By performing the pressing step, the narrowing step and the hitting step as described above, the ballpoint pen tip 20 can be formed with the recess 42, the inclined surfaces 43, the troughs 44 and the ball receiving seat surfaces 41. In this way, partially faint written traces of the ink can be prevented and the ballpoint pen tip 20 that can assure smooth writing can be easily realized.

Note that the present invention is not limited to the above embodiment and includes modifications, improvements and the like made within a scope that the object of the present invention can be achieved.

For example, the ballpoint pen is not limited to a retractable one in which a pen tip is projected and retracted by pressing a button provided at the rear end of a shaft tube and may be a twist-type ballpoint pen in which a pen tip is projected and retracted by twisting a rear end part of a shaft tube. A mechanism for projecting and retracting the pen tip can be arbitrarily selected in implementation.

Moreover, the ballpoint pen may be a ballpoint pen including no mechanism for projecting and retracting a pen tip such as a cap-type ballpoint pen in which a cap for covering a pen tip is removably mounted.

Furthermore, the ballpoint pen is not limited to a ballpoint pen including one ballpoint pen refill in a shaft tube and may be a ballpoint pen including two or more ballpoint pen refills or including a mechanical pencil refill in addition to a ballpoint pen refill in a shaft tube.

INDUSTRIAL APPLICABILITY

The present invention is applicable to a ballpoint pen tip and a ballpoint pen refill and a ballpoint pen including this ballpoint pen tip.

The invention claimed is:

1. A ballpoint pen tip comprising a writing ball for transferring ink attached to a surface thereof to a writing object and a holder having this writing ball rotatably provided at a tip;

the holder being provided with:

a ball housing formed as a housing space for rotatably housing the writing ball, a back hole extending from the rear end of the holder to the vicinity of the ball housing, and an ink guide hole having a section arcuately curved towards an outer edge and allowing the ball housing and the back hole to communicate with each other;

a recess gradually tapered toward the ink guide hole being formed in the bottom of the ball housing;

the recess being provided with:

a plurality of inclined surfaces inclined in such a way that normals of the plurality of inclined surfaces pointing out of a volume point towards a center axis of the pen, and a plurality of troughs formed in parts where these inclined surfaces intersect and extending radially from the ink guide hole to serve as channels communicating the ink guide hole and a frontal part of the writing ball;

each of the inclined surfaces being formed with a ball receiving seat surface composed of a concave surface corresponding to the spherical surface of the writing ball to receive the writing ball; and each of the ball receiving seat surfaces being formed inclined in such a way that normals of the ball receiving seat surfaces pointing out of the volume point towards the center axis of the pen, with an arcuately curved peripheral edge.

2. The ballpoint pen tip according to claim 1, wherein the recess is formed with three inclined surfaces inclined in such a way that the normals of the inclined surfaces pointing out of the volume point towards the center axis of the pen.

3. A ballpoint pen refill comprising a ballpoint pen tip, comprising a writing ball for transferring ink attached to a surface thereof to a writing object and a holder having this writing ball rotatably provided at a tip;

the holder being provided with:

a ball housing formed as a housing space for rotatably housing the writing ball, a back hole extending from the rear end of the holder to the vicinity of the ball housing, and an ink guide hole having a section arcuately curved towards an outer edge and allowing the ball housing and the back hole to communicate with each other;

a recess gradually tapered toward the ink guide hole being formed in the bottom of the ball housing;

the recess being provided with:

a plurality of inclined surfaces inclined in such a way that normals of the plurality of inclined surfaces pointing out of a volume point towards a center axis of the pen, and a plurality of troughs formed in parts where these inclined surfaces intersect and extending radially from the ink guide hole to serve as channels communicating the ink guide hole and a frontal part of the writing ball;

each of the inclined surfaces being formed with a ball receiving seat surface composed of a concave surface corresponding to the spherical surface of the writing ball to receive the writing ball; and each of the ball receiving seat surfaces being formed inclined in such a way that normals of the ball receiving seat surfaces pointing out of the volume point towards the center axis of the pen, with an arcuately curved peripheral edge.

4. A ballpoint pen comprising ballpoint pen tip comprising a writing ball for transferring ink attached to a surface thereof to a writing object and a holder having this writing ball rotatably provided at a tip;

the holder being provided with:

a ball housing formed as a housing space for rotatably housing the writing ball, a back hole extending from the rear end of the holder to the vicinity of the ball housing, and an ink guide hole having a section arcuately curved towards an outer edge and allowing the ball housing and the back hole to communicate with each other;

a recess gradually tapered toward the ink guide hole being formed in the bottom of the ball housing;

the recess being provided with:

a plurality of inclined surfaces inclined in such a way that normals of the plurality of inclined surfaces pointing out of a volume point towards a center axis of the pen, and a plurality of troughs formed in parts where these inclined surfaces intersect and extending radially from the ink guide hole to serve as channels communicating the ink guide hole and a frontal part of the writing ball;

each of the inclined surfaces being formed with a ball receiving seat surface composed of a concave surface corresponding to the spherical surface of the writing ball to receive the writing ball; and each of the ball receiving seat surfaces being formed inclined in such a way that normals of the ball receiving seat surfaces pointing out of the volume point towards the center axis of the pen, with an arcuately curved peripheral edge.

5. The ballpoint pen tip according to claim 1, wherein the troughs or their extension lines do not intersect with a surface of the writing ball when the writing ball is seated in the ball receiving seat surfaces.

* * * * *